United States Patent [19]

Eisermann

[11] Patent Number: 4,987,758

[45] Date of Patent: Jan. 29, 1991

[54] BURGLARPROOF LOCK

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 412,278

[22] Filed: Sep. 25, 1989

[30] Foreign Application Priority Data

Oct. 1, 1988 [DE] Fed. Rep. of Germany ..... 3833403

[51] Int. Cl.[5] ..... E05B 17/04

[52] U.S. Cl. ..... 70/379 R; 70/1.7

[58] Field of Search ..... 70/1.5, 1.7, 333, 416, 70/379 R; 109/30

[56] References Cited

U.S. PATENT DOCUMENTS 1,904,882 4/1933 Prior ..... 70/1.5

2,874,563 2/1959 Sellage ..... 70/455

3,263,463 8/1966 Duval ..... 70/455

*Primary Examiner*—Robert L. Wolfe

*Attorney, Agent, or Firm*—Martin A. Farber

[57] ABSTRACT

The present invention relates to a lock (3) on the inside of a door, wherein the lock can be actuated from outside the door. The lock is connected to a locking device (14) on the outer side of the door by a coupling rod (12). In order to increase protection against burglaries, the coupling rod (12) is to pass through a channel (22) with which a channel closure jaw (28) is associated. The jaw is supported on the coupling rod (12) and is under spring-load in the direction of closure. Removal of the coupling rod during a burglary attempt results in a closure of the channel with protection of the lock from tampering by the jaw.

6 Claims, 3 Drawing Sheets

BURGLARPROOF LOCK

FIELD AND BACKGROUND OF THE INVENTION

The present invention relates to a lock which can be actuated from the outer side of a door or the like and which is connected to the closing means on the outer side of the door by a coupling rod or the like.

In such locks a considerable lack of security resides in the fact that after a forceful removal of the closing means on the outer side of the door, the lock can be actuated by a tool so as to bring it into the open position. Upon removal of the closing means, the opening of the lock which receives the coupling rod is exposed so that a tool—for instance, a screwdriver—can engage in it.

SUMMARY OF THE INVENTION

It is therefore the object of this invention so to develop a lock of the type in question in a manner which is simple to manufacture and more secure against unauthorized opening and such that, after removal of the closing means on the outer side of the door, the lock-side opening for the coupling rod can no longer be reached.

According to the invention the coupling rod (12) passes through a channel (22) with which there is associated a channel closure jaw (28) which rests on the coupling rod (12) and is spring-loaded in the direction of closure.

As a result of this development, a lock of the type described which affords increased security is created. Upon the forceful removal of the locking device on the outer side of the door with simultaneous removal of the coupling rod, the rod leaves the channel so that the channel-closure jaw which is urged by spring in the closing direction comes into a channel-closing position. It is then impossible to reach with a tool through the channel from outside the door in order to reach the opening in the lock which previously still received the coupling rod. Even the coupling rod can then no longer be introduced from the outer side of the door due to the fact that the closure jaw has entered into the channel. This securing against unauthorized opening in the manner described above can be achieved with inexpensive means.

It is particularly advantageous to arrange the channel in the bushing. The latter is so inserted in an opening in the door that the bushing cannot be pulled out from the outer side of the door. Nor can it be pushed towards the inner side of the door due to the lock present there. This bushing serves at the same time to receive the channel closure jaw which can be displaced in the transverse slot. The jaw has the shape of a wall segment. When the coupling rod has been inserted, said wall segment is supplemented by the remaining cross-section of the bushing at the height of the transverse slot so as to form a circle. When the coupling rod leaves the channel, the wall segment or the channel closure jaw is displaced in inward direction and accordingly extends into the channel in such a manner that application of a tool does not permit displacement of the channel closure jaw into a release position.

The spring which acts on the channel closure jaw is also developed very simply and economically from a structural standpoint. For this purpose, an elastic spring ring has been selected which surrounds the bushing and the jaw, it gripping around the jaw at the height of the transverse slot. As a result, the jaw constantly endeavors to close off the channel. In order nevertheless to make it possible, after the installation of the bushing and closure jaw, to insert the coupling rod from the outer side of the door, the channel closure jaw has a run-on bevel on its flank facing the inner side of the door. Before insertion of the coupling rod, a tool inserted from the inner side of the door strikes against said run-on bevel together with an outward displacement of the channel closure jaw. By pushing the tool back, the coupling rod can then pass through the channel. The closure rod then acts as a clamping body on the closure rod so that a clamping seat of the bushing with closure jaw on the coupling rod is created.

Large pull-out forces acting on the bushing can be taken up without damage due to the fact that the bushing has a plate-shaped flange on its front side facing the inner side of the door. This flange is preferably integral with the bushing. If the transverse slot in the bushing completely passes through the channel and the bottom of the transverse slot terminates on the other side of the channel wall, then the closure jaw cannot be shifted from the outer side of the door even by a very pointed or knife-like burglary tool.

With the above and other objects and advantages in view, the present invention will become more clearly understood in connection with the detailed description of a preferred embodiment, when considered with the accompanying drawings, of which:

FIG. 1 is a stop-side view of the door in the region of the lock with which a closing means on the outer side of the door is associated, FIG. 2 is a vertical section through the door at the height of the coupling rod which couples the corresponding parts of the lock and of the lock mechanism with each other, FIG. 3 is a section along the line III—III in FIG. 2, FIG. 4 is a section similar to FIG. 2, in which the closing means together with the coupling rod have been removed and the channel closure jaw has passed into the closing position, and FIG. 5 is a section along the line V—V in FIG. 4.

DETAILED DESCRIPTION OF THE PREFERRED EMBODIMENTS

Figure 1:
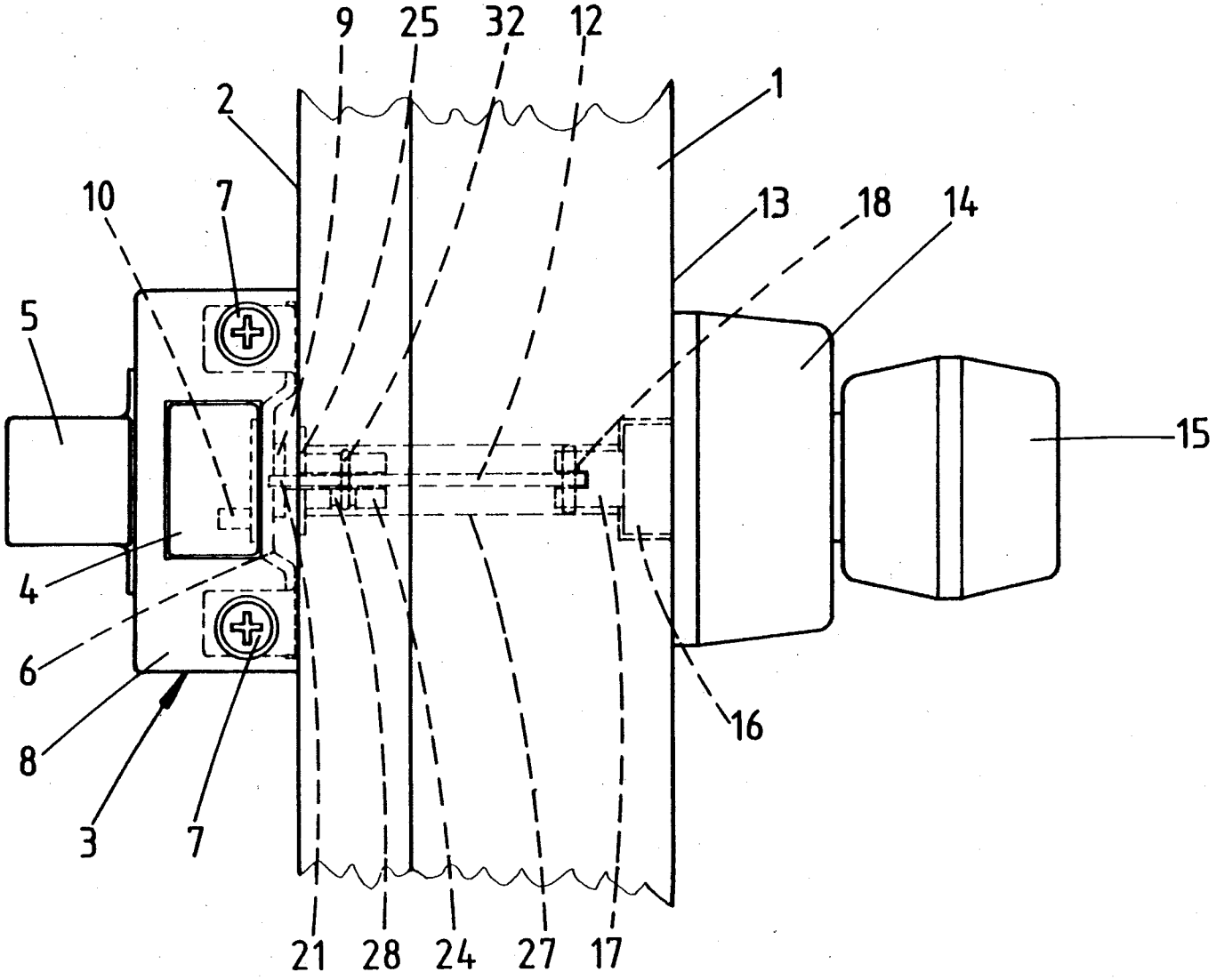
Figure 2:
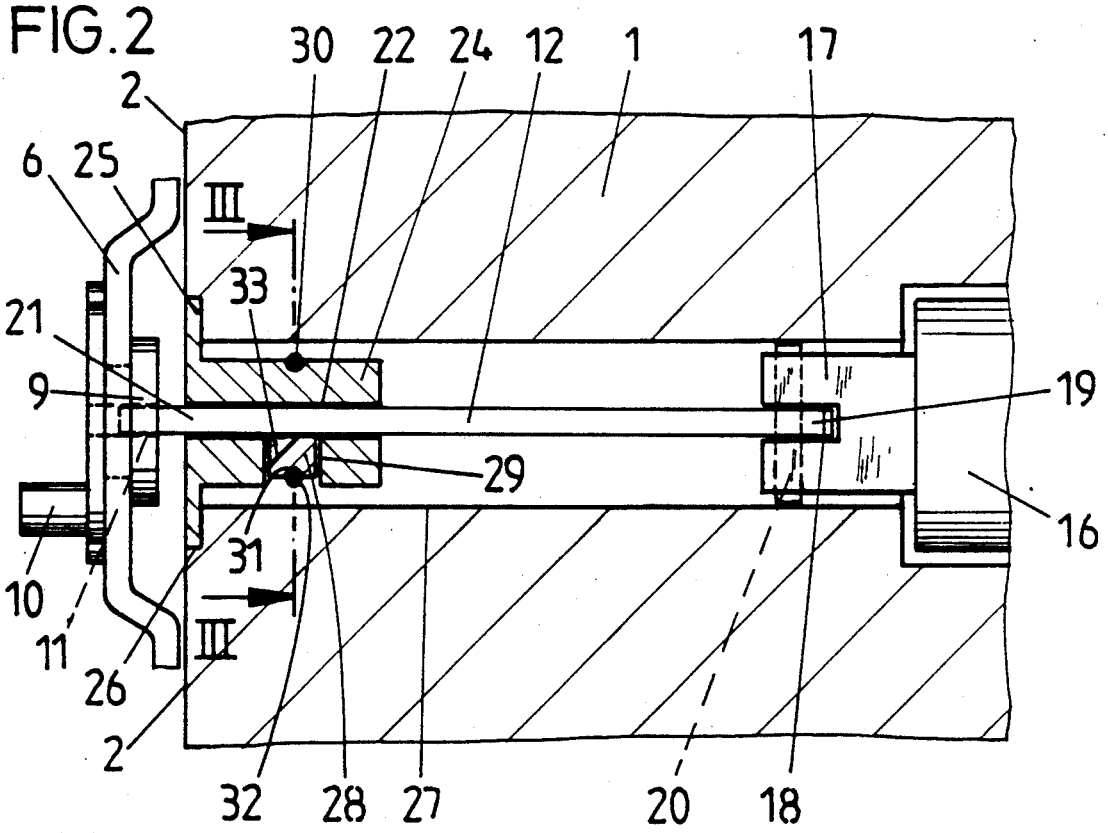
Figure 3:
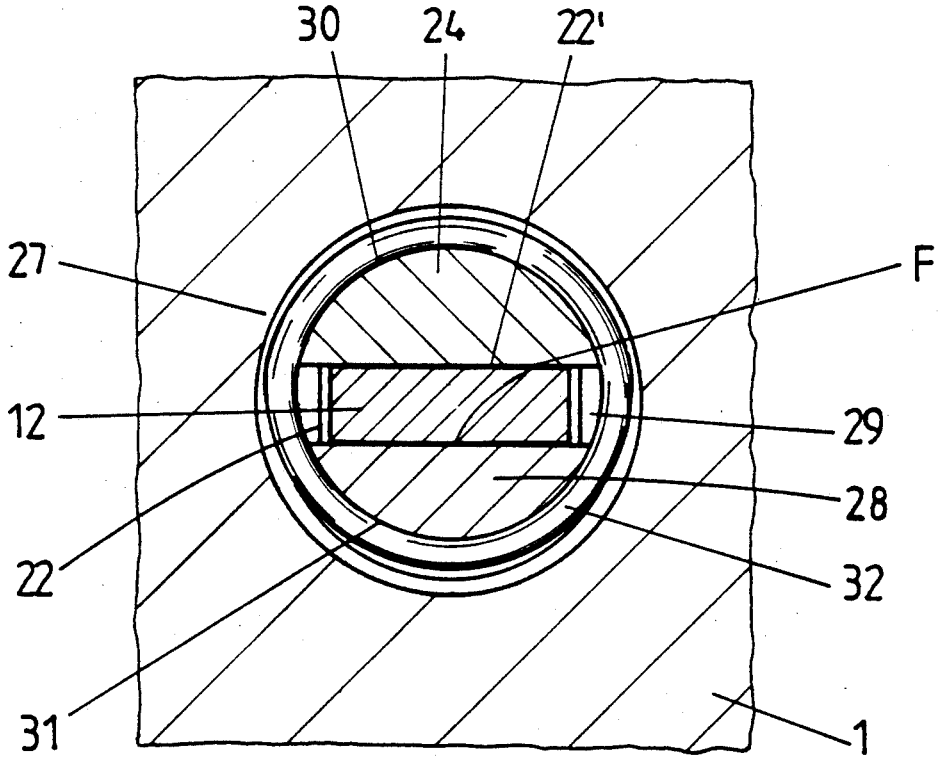
Figure 4:
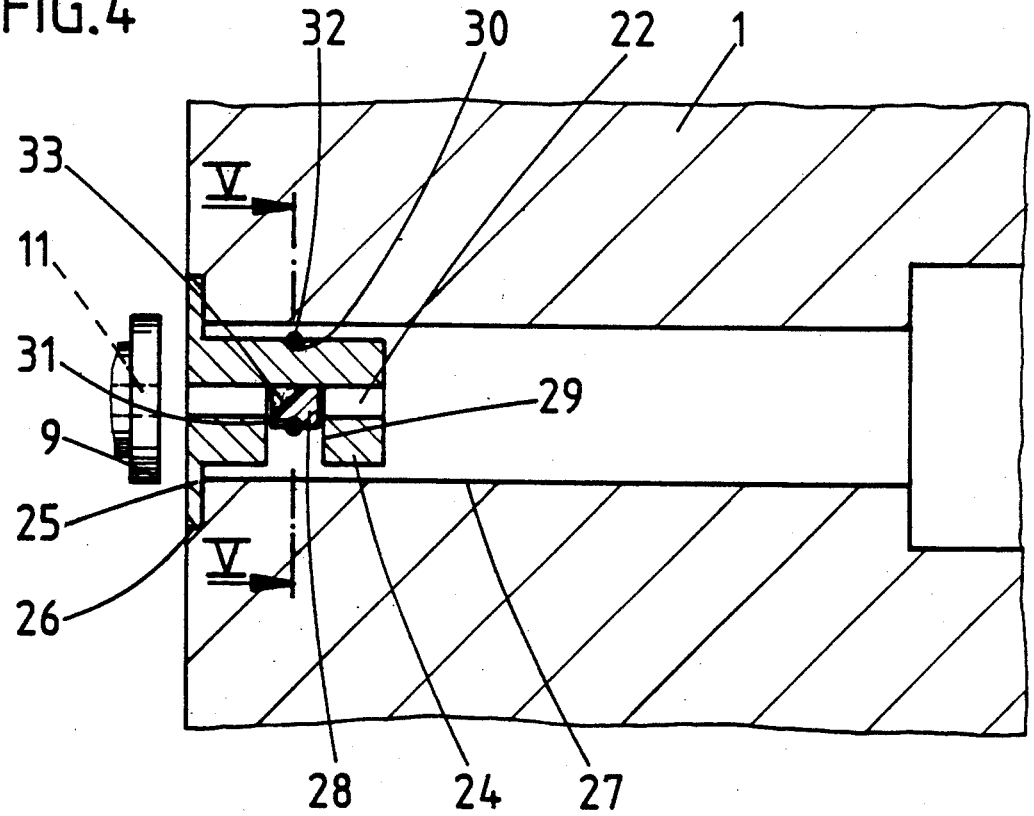
Figure 5:
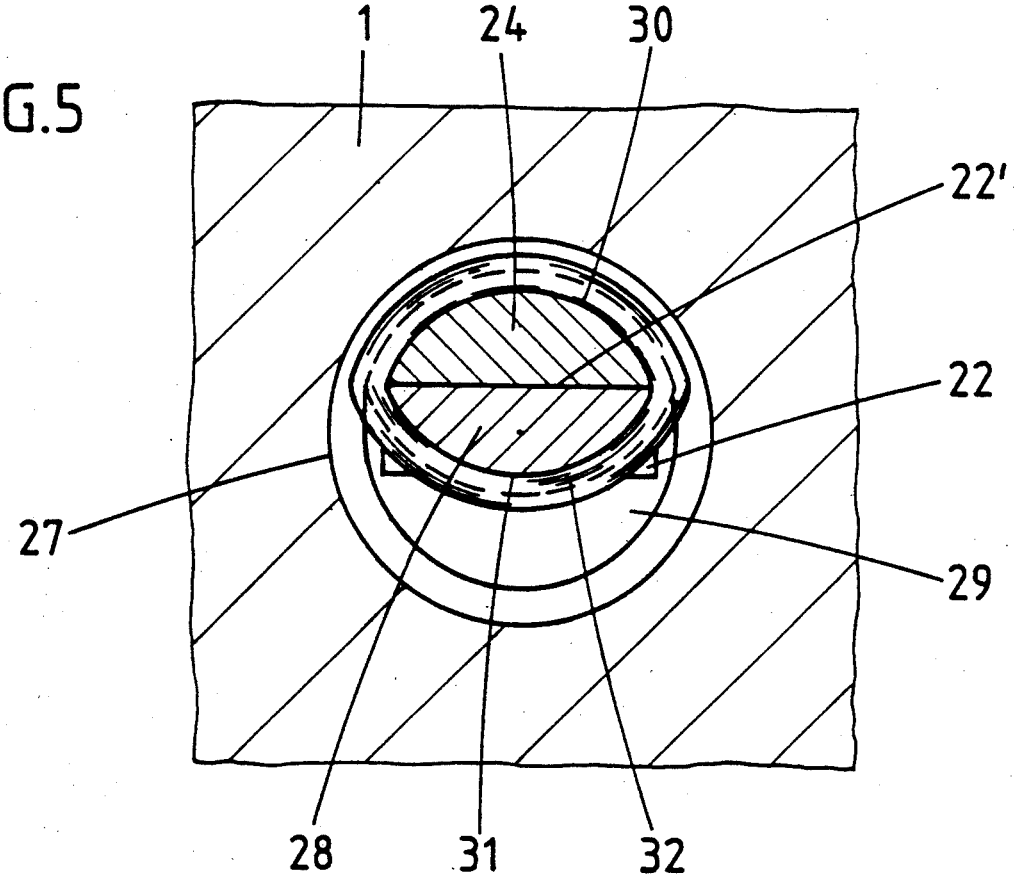

A door, designated 1, bears on its inner side 2 a case-like lock 3 of customary construction. The latter contains a bolt 4 which can be advanced and retracted. The bolt can be actuated from the inner side of the door by means of a lock cylinder (not shown) which is arranged in a front-side housing projection 5 of the lock 3.

The lock inner mechanism is covered by a lock cover 6 adjacent the inner side 2 of the door 1, the lock cover being attached to the lock housing 8 by screws 7.

The lock cover 6 bears a turnable driver 9 which is functionally connected with the lock mechanism by means of a pin 10 extending into the lock. The turnably mounted drive 9 has an opening 11 of rectangular cross section which extends in axial direction. This opening is adapted to the cross-section of a coupling rod 12 which connects the lock 3 to a closing means 14 arranged on the outer side 13 of the door. The closing means can be one which can be actuated after insertion of a magnetically coded key card (not shown). For this there is used an outer turn knob 15 associated with the closing means 14 and which, after insertion of the proper key card, comes into coupling engagement with a nut 16 of the closing means 14. The bolt 4 can thereby be advanced and retracted.

The nut 16 bears a square mandrel 17. A slot 18 provided in the front end of said mandrel receives the end 19 of the coupling rod 12 which is located on the outer side of the door. By a transverse pin 20 which passes both through the square mandrel 17 and through the end 19 of the coupling rod 12, the two are connected together to form a single unit.

The end 21 of the coupling rod 12 which is located on the inner side of the door passes through a channel 22 and enters, with form-lock, into the opening 11 of the rotatably mounted drive 9. The channel 22 in front of the drive 9 is arranged in a bushing 24. The front side of said bushing which faces the inner side 2 of the door has a plate-shaped flange 25 which is received by a recess 26 provided on the inner side of the door. A bore 27 adjoins the recess 26, the bushing 24 extending into said bore. As a result of this development, the bushing 24 cannot be pulled out in the direction towards the outer side of the door due to the fact that it is supported on the inner side 2 of the door.

A channel closure jaw 28 is associated with the channel 22. The channel closure jaw is spring-urged in the direction of closure and rests against the wide surface of the coupling rod 12 which faces it. The channel closure jaw 28 has the shape of a wall segment which rests in a transverse slot 29 in the bushing 24. This transverse slot 29 passes through the entire channel cross section and extends up to the corresponding channel wall 22, At the height of the transverse slot 29, the bushing is provided with an annular groove 30 which continues into a partial annular groove 31 of the wall segment or the channel closure jaw 28. At the height of the annular groove 30 and of the partial annular groove 31, the closure jaw 28 and the bushing 24 are surrounded by an elastic spring ring 32. In this embodiment the latter consists of rubber and is placed-on with tension so that the closure jaw 28 endeavors to move in the direction of the channel wall 22'. If the coupling rod 12 is not in the channel 22, then the wall segment applies itself, due to the spring-load, with its chord-like extending surface F against the channel wall 22'.

The insertion of the coupling rod 12 from the outer side of the door can nevertheless take place even when the closure jaw 28 is mounted, due to a control bevel 33 provided on its flank which bevel faces the inside of the door. Before insertion of the coupling rod 12 into the channel 22, the control bevel 33 is acted on, for instance by the blade of a screwdriver inserted from the inner side of the door, with simultaneous radial outward displacement of the channel closure jaw 28 against the force of the spring ring 32. The passage for the coupling rod 12 is in this way opened, the rod pushing the blade of the screwdriver back upon its insertion. This control bevel 33 can also be of importance if, instead of a connection of the coupling rod 12 to the square mandrel 17 by a pin 20, an irreversible plug/detent connection is provided. The coupling rod 12 can then be installed also from the inner side of the door, its end striking against the control bevel 33 of the closure jaw 28 and displacing it.

As an alternative, before the first mounting, the closure jaw 28 can also be held in the release position by a filler piece which, upon insertion of the coupling rod 12 from the outer side of the door, is pushed out of the channel 22 by the end of the coupling rod 12. For this purpose, the filler piece is made shorter than the bushing 24 so as to obtain a threading effect.

If the closing means 14 is removed during an attempted burglary, then the coupling rod 12 simultaneously leaves the opening 23 of the drive 9 as well as the channel 22. As soon as the channel closure jaw 28 no longer finds any support on the coupling rod 12, the closure jaw 28 is displaced radially inward by the spring ring 32 until it rests with its chord-like surface F against the channel wall 22'. It is then no longer possible to reach through the channel 22 by means of a burglary tool, a screwdriver or the like, in order to turn the driver 9.

The transverse slot could also be cut so deep that the closure jaw 28 rests in its locking position beyond the channel wall 22'. The displacement path of the closure jaw 28 is, in this case, greater than the thickness of the channel 22.

I claim:

1. A lock assembly for a door or similar type of panel, wherein the lock assembly comprises a lock disposed on the inner side of the door to be actuated from the outer side of the door;

a closing means on the outer side of the door;

a coupling rod extending through the door for connecting the lock to the closing means;

a bushing having a channel, the bushing being located between said closing means and said lock, the coupling rod passing through the channel;

a channel closure jaw positioned at a side of said channel; and wherein said closure jaw is spring loaded against said coupling rod to close said channel in the absence of said coupling rod; and said bushing includes a slot which is transverse to and opening into said channel, the channel closure jaw being formed as a wall segment within the transverse slot of said bushing.

2. A lock assembly according to claim 1, further comprising an elastic spring ring, the bushing being surrounded in the cross-sectional plane of the jaw by said elastic spring ring.

3. A lock assembly according to claim 1, wherein said channel closure jaw has a flank, there being a control bevel on said flank, said bevel facing the inner side of the door.

4. A lock assembly according to claim 1, said bushing has a plate-shaped flange on the front side of the bushing facing the inner side of the door.

5. A lock assembly according to claim 1, wherein said transverse slot passes completely through said channel; and the bottom of the transverse slot terminates on a sidewall of said channel opposite said closure jaw.

6. A lock assembly according to claim 1, further comprising a filler piece insertable in said channel within said bushing; and wherein said channel closure jaw is held in an open position releasing the channel by said filler piece, the filler piece being pushed out by insertion of said coupling rod.

* * * * *